US009518308B2

(12) United States Patent
Mohammad et al.

(10) Patent No.: US 9,518,308 B2
(45) Date of Patent: Dec. 13, 2016

(54) HIGH-DENSITY AND HIGH-STRENGTH WC-BASED CEMENTED CARBIDE

(71) Applicant: King Fahd University of Petroleum and Minerals, Dhahran (SA)

(72) Inventors: Khwaja Mohammad, Dhahran (SA); Nouari Saheb, Dhahran (SA); Tahar Laoui, Dhahran (SA); Nasser Al-Aqeeli, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 381 days.

(21) Appl. No.: 14/138,177

(22) Filed: Dec. 23, 2013

(65) Prior Publication Data

US 2015/0176106 A1 Jun. 25, 2015

(51) Int. Cl.

| | |
|---|---|
| ***C22C 29/08*** | (2006.01) |
| ***C22C 1/05*** | (2006.01) |
| ***B22F 3/105*** | (2006.01) |

(52) U.S. Cl.

CPC ..... *C22C 1/051* (2013.01); *B22F 3/105* (2013.01); *C22C 29/08* (2013.01); *B22F 2003/1051* (2013.01); *B22F 2301/15* (2013.01); *B22F 2302/10* (2013.01); *B22F 2304/054* (2013.01)

(58) Field of Classification Search

CPC ..... C22C 29/02; C22C 1/051; B22F 3/105

See application file for complete search history.

(56) References Cited

U.S. PATENT DOCUMENTS 8,720,610 B2 * 5/2014 Lanning ..... E21B 10/54 175/382

FOREIGN PATENT DOCUMENTS

| | | |
|---|---|---|
| CN | 100575515 | 12/2009 |
| CN | 101665881 | 10/2010 |
| CN | 102628138 | 8/2012 |
| WO | 99/13120 | 3/1999 |

OTHER PUBLICATIONS

Wang, et al., "Grain growth during the early stage of sintering of nanosized WC—Co powder," International Journal of Refractory Metals & Hard Materials 26 (2008) 232-241.*

Kumar et al., "Sintering behavior of nanostructured WC—Co composite" Ceramics International 37 (2011) 1415-1422.*

Zhu et al, "Preparation of nanocrystalline WC—10Co—0.8VC by spark plasma sintering" Journal of Materials Science Letters 22, 2003, 1631-1633.*

L. Yiwen, et al. "Sintering Characteristics and Microstructure of WC—Co—VC/$Cr_3C_2$ Ultrafine Cemented Carbides", Rare Metals, vol. 28, No. 5, pp. 482-486. (Oct. 2009).

K. Bonny, et al. "Impact of $Cr_3C_2$/VC Addition on the Dry Sliding Friction and Wear Response of WC—Co Cemented Carbides", Wear, pp. 1642-1652. (2009).

* cited by examiner

*Primary Examiner* — Jessee Roe
*Assistant Examiner* — Christopher Kessler
(74) *Attorney, Agent, or Firm* — Oblon, McClelland, Maier & Neustadt, L.L.P.

(57) ABSTRACT

The synthesis of high performance WC-Co cemented carbides which can be efficiently used in the cutting tool industry. WC with different particle sizes and different grain growth inhibitors were consolidated through spark plasma sintering technique and to form a cemented carbide with best combination of mechanical properties. VC and $Cr_3C_2$ are included as grain growth inhibitors in different amounts and combination to the WC-Co powder composition. Higher amount of inhibitors results in lower grain sizes and higher hardness values, however adding more than a crucial amount was observed to degrade the mechanical properties.

13 Claims, 10 Drawing Sheets

HIGH-DENSITY AND HIGH-STRENGTH WC-BASED CEMENTED CARBIDE

BACKGROUND

Field of the Disclosure

The invention relates to a method for making a WC-Co cemented carbide, the WC-Co cemented carbide made by the method, and cutting tools containing the WC-Co carbide.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Certain applications require materials exhibiting combination of both hardness and toughness. One of these applications is tooling industry which needs higher hardness of tool for cutting and higher toughness to sustain jerks and vibration during cutting. WC-Co is a widely used material in the tool industry. Improvement in attaining higher values of the combination of these properties is necessary in order to cut difficult substrates such as rock.

Tungsten carbide is a material that is formed by reacting tungsten and carbon. In its most basic form tungsten carbide includes only atoms of tungsten and carbon. Tungsten carbide (WC) has many desirable properties and is used for manufacturing cutting tools such as drilling/milling bits.

Tungsten carbide is often used in the form of an alloy with a matrix material such as another metal. Tungsten carbide cobalt (WC-Co) compositions are used where sintered tungsten carbide is described. A WC-Co material includes WC grains or particles dispersed in or alloyed with a Co matrix. Tungsten carbide cobalt can be described as a composition including a hard ceramic phase (WC) and a ductile metallic phase (Co) in which the hard ceramic phase is an alloy of the ductile metallic phase. Most commonly such carbide alloys are formed by thermally treating a mixture of a tungsten carbide powder and a metal powder and are sometimes characterized according to the grain size of the alloy.

Cutting tools for use in applications such as drilling rock need cutting surfaces having extreme hardness and toughness. Conventionally, hardness and toughness in drilling bit applications has been achieved by including additional materials of high hardness together with WC. This strategy substantially increases the costs of the cutting tool and requires complex manufacturing methods. The present disclosure describes a method for making a tungsten carbide cobalt material having low grain size and a desirable combination of hardness and toughness characteristics and its use for making cutting tools.

Drilling companies have used WC-based cemented carbides that are mixed with diamond particles in order to attain composites with higher hardness and toughness values. This approach (adding diamond reinforcements) in developing drilling materials is very expensive. The presented disclosure provides a technological route that result in alloys that retain their nano-grains which resulted in achieving an excellent combination of hardness and toughness which are both needed to achieve competitive drilling materials. Our comprehensive experiments and the analysis provide excellent insight into all possible options to synthesize these materials with the addition of commonly used grain growth inhibitors (VC and $Cr_3C_2$). We have explored most of the options in terms of adding different quantities of inhibitors and different quantities of the binding material. Additionally, we have explored the effect of consolidating these materials using different temperatures of SPS (1200° C. and 1300° C.).

It is now disclosed that the addition of different amounts and combinations of grain growth inhibitors to a basic WC-Co powder provides a refined microstructure thus improving hardness in combination with improving toughness.

SUMMARY

One embodiment of the present disclosure includes a method for synthesizing a tungsten carbide cobalt composition including one or more grain growth inhibitors.

In another embodiment of the invention a tungsten carbide cobalt material is made by sintering a mixture of tungsten carbide and cobalt with one or more grain growth inhibitors.

In another embodiment of the invention a tungsten carbide cobalt is made using tungsten carbide particles of nanometer scale.

In another embodiment of the invention a tungsten carbide cobalt material is made by spark plasma sintering a mixture of nano scale WC particles in the presence of one or more grain growth inhibitors and a metal.

In other embodiment the present disclosure includes a WC-Co cemented carbide made by spark plasma sintering in the presence of two different grain growth inhibitors and having a combination of high hardness and toughness sufficient for rock drilling applications.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
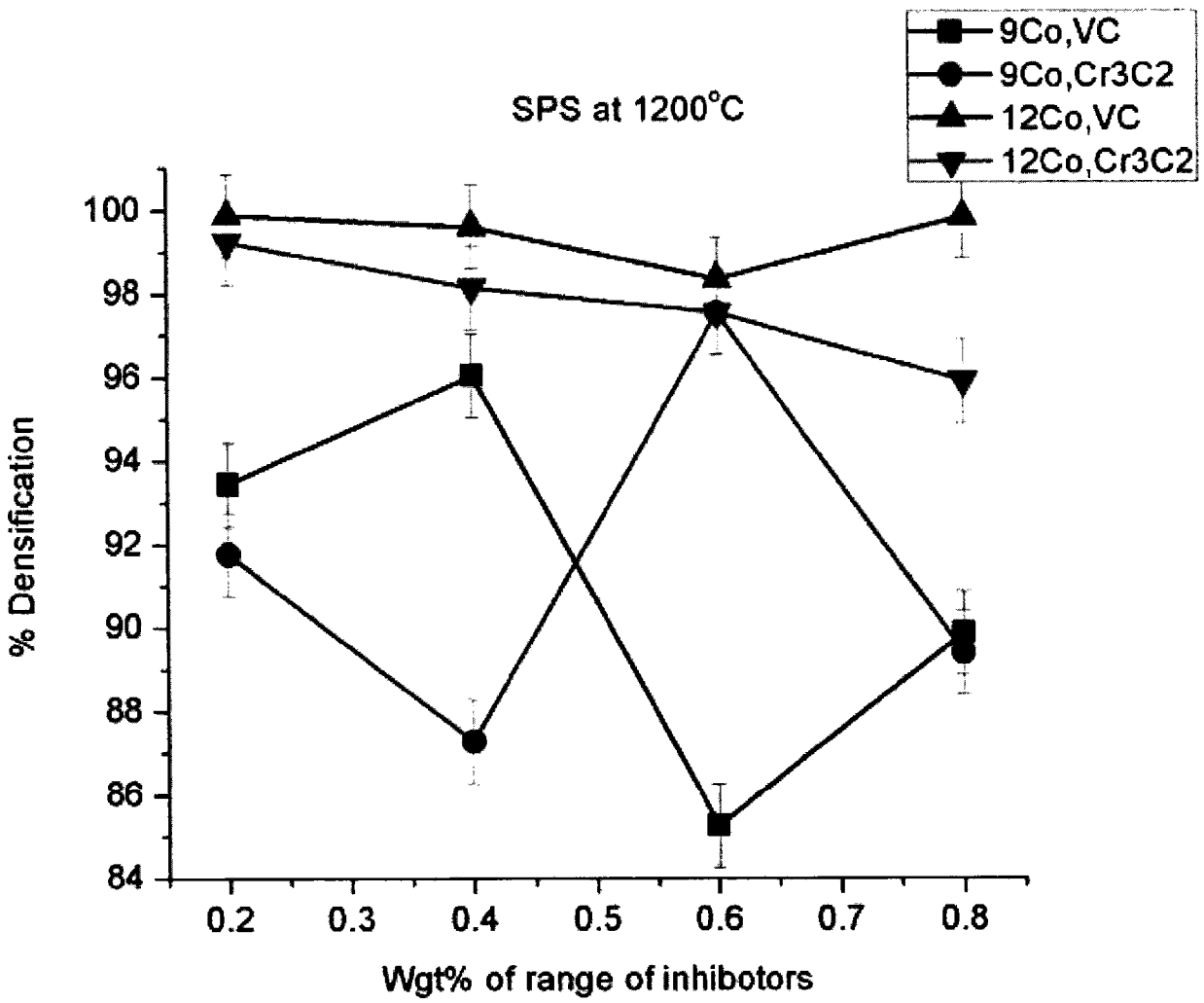
FIG. 1 shows densification of a spark plasma sintered composition at different inhibitor amounts.
Figure 2:
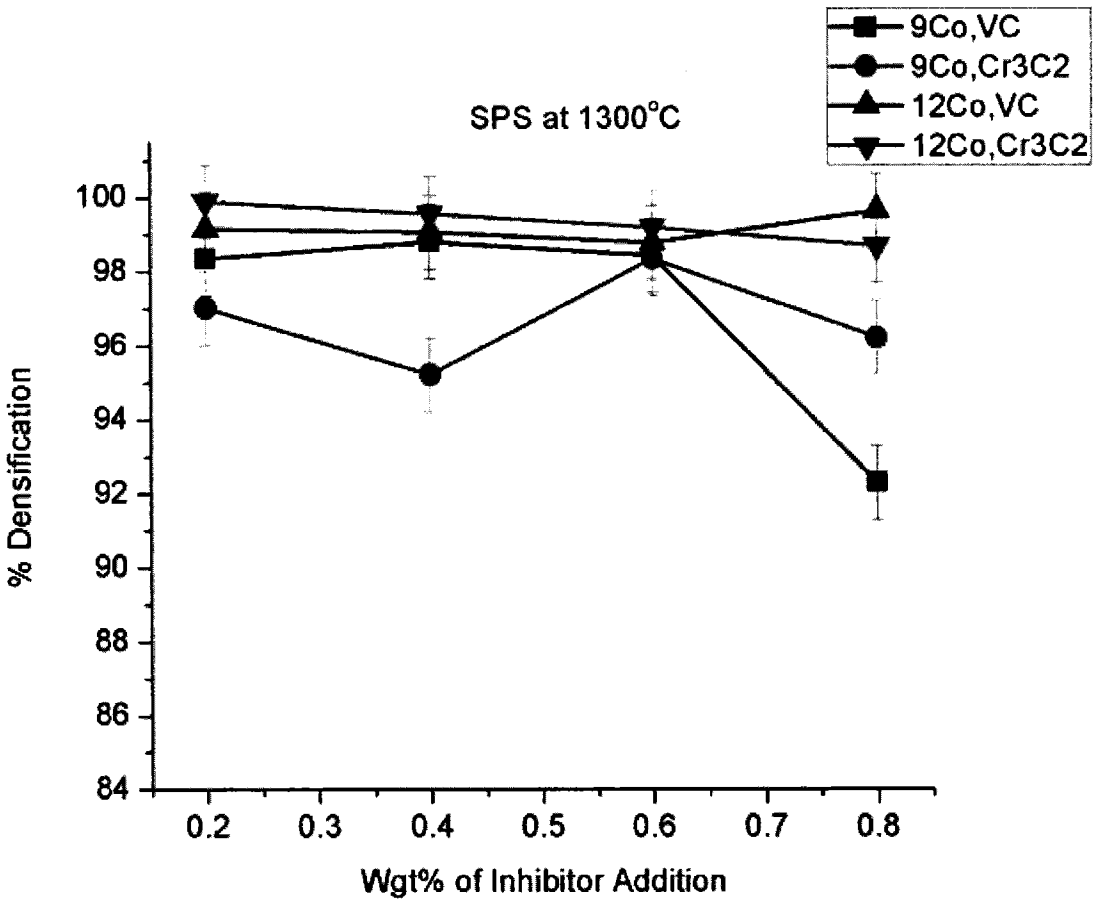
FIG. 2 shows densification of compositions by spark plasma sintering at differing amounts of grain growth inhibitors.
Figure 3:
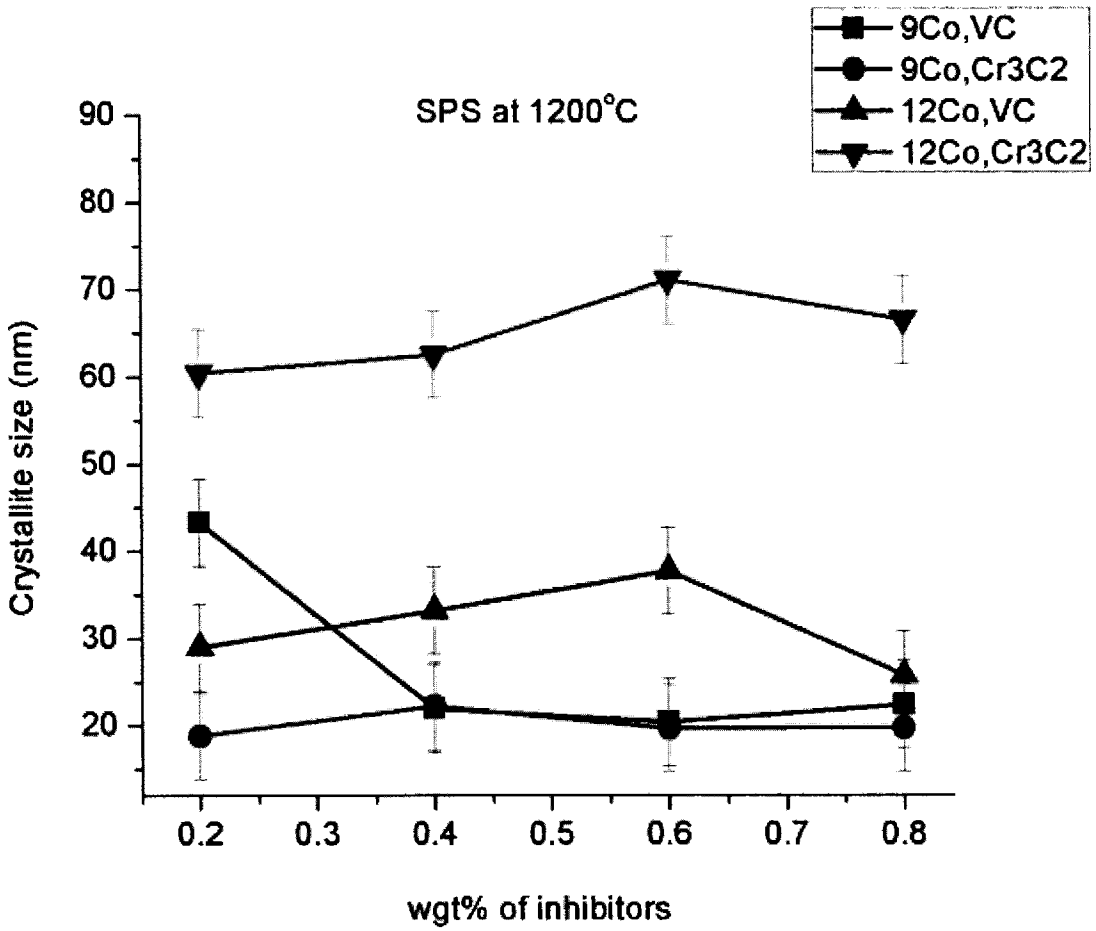
FIG. 3 shows crystallite size of compositions spark plasma sintered at varying grain growth inhibitor amounts.

Referring now to the drawings, wherein like reference numerals designate identical or corresponding parts throughout the several views.

The tungsten carbide cobalt sintered composition preferably contains only cobalt as the alloying metal. While other matrix metals may be present in small amounts, it is preferred that cobalt is the only matrix metal acting as a ductile metallic material. Small amounts of matrix metals may be included but are preferably present in an amount of less than 1%, less than 0.5%, less than 0.1% and most preferably present in an amount of less than 0.01% by weight based on the total weight of the matrix metal. The carbide phase of the tungsten carbide cobalt preferably contains only tungsten carbide without any other metal carbide material. While small amounts of other metal carbides may be present, such amounts are preferably less than 1%, less than 0.5%, less than 0.1% and most preferably less than 0.01% by mass based on the total amount of metal carbide materials.

The tungsten carbide particles used to make the tungsten carbide cobalt are nano-scale powders preferably having an average diameter of 50 nm or less, more preferably less than 25 nm, less than 5 nm and most preferably in the range of 1-10 nm. Preferably the tungsten carbide particles do not contain any particles having an average diameter of greater than 20 nm, preferably greater than 50 nm, more preferably greater than 100 nm, or preferably no more than 1,000 nm.

The tungsten carbide cobalt may contain cobalt in amounts of from 0.1 to 15% by weight based on the total weight of tungsten carbide and cobalt. More preferably the cobalt is present in an amount of from 9-12 wt %, more preferably 10-11 wt % or about 10 wt % where "about" represents a variance of ±10%. Representative compositions may be represented as, for example, WC-12Co or WC-9Co to describe compositions that contain 12 wt % and 9 wt % respectively, of cobalt.

The tungsten carbide cobalt contains one or more grain growth inhibitors, preferably two different grain growth inhibitors. The preferred grain growth inhibitors are VC (vanadium carbide) and $Cr_3C_2$ (chromium carbide), preferably both VC and $Cr_3C_2$ are present in the tungsten carbide cobalt. Each grain growth inhibitor may be present in an amount of 0.1-1.0 wt % based on the total amount of tungsten carbide and cobalt. Preferably the grain growth inhibitors are present in an amount of from 0.2-0.9 wt %, 0.3-0.8 wt %, 0.4-0.7 wt %, 0.5-0.6 wt %. The grain growth inhibitors may have particle sizes similar to the particle size of the tungsten carbide or particle sizes that are in the micron scale rather than the nano scale.

In an embodiment the tungsten carbide cobalt contains both vanadium carbide and chromium carbide as grain growth inhibitors. The vanadium carbide and chromium carbide may be present in ratios $VC/Cr_3C_2$ of 0.2-1.0, 0.5-0.9, 0.6-0.8 or about 0.5. Alternately, the $Cr_3C_2/VC$ ratio may range from 0.2-1.0, 0.5-0.9, 0.6-0.8 or about 0.7, based on the respective weight percent amounts of the VC and the $Cr_3C_2$. The tungsten carbide cobalt containing grain growth inhibitors has improved toughness, hardness, densification and crystallite properties. Densification of spark plasma sintered compositions is preferably more than 90%, more preferably more than 92%, 94%, 96% or from 98-100%. Crystallite size is preferably small in the spark plasma sintered cemented tungsten carbide cobalt material. Crystallite size may range to 100 nm, preferably less than 70 nm, less than 50 nm, or from 30 to 10 nm. Hardness ($H_v$ 30) is high and is preferably greater than 800, more preferably greater than 900, greater than 1,000 or from 1,100 to 1,200. In other embodiments the Vickers hardness is up to 2,000 or preferably in the range of 1,800-1,200 or 800-1,750. Fracture toughness is greater than 10, preferably greater than 11, 12, or 13. In some embodiments fracture toughness of the spark plasma sintered composite is from 10 to 14.

The tungsten carbide cobalt nano-structured cemented material is prepared by spark plasma sintering (SPS) a composition containing tungsten carbide particles, cobalt metal, vanadium carbonate particles and chromium carbonate particles. Spark plasma sintering is a technique that utilizes a pulsed on/off DC electrical current utilizing uniaxially force under low pressure. Spark plasma sintering occurs at high speed to consolidate the powder mixture containing the tungsten carbide, cobalt, vanadium carbide and chromium carbide. Spark plasma sintering quickly raises the temperature of the powder composition to 1,200° C. or more to thereby consolidate and cement the pulverulent components of the tungsten carbide cobalt cement that contains vanadium carbide and chromium carbide grain growth inhibitors. The high speed heating permits consolidation of the pulverulent mixture so that the tungsten carbide particles present in the pulverulent powder maintain their particle size and disaggregation upon sintering. Slower sintering method tend to result in consolidation and/or agglomeration of one or more components of the pulverulent mixture thereby forming a disadvantaged sintered mass in which grain size is undesirably large and/or inhomogeneously dispersed in a metal matrix. Grain growth is further suppressed by the inclusion of the vanadium carbide and/or chromium carbide.

Carrying out sintering using spark plasma sintering on pulverulent compositions that contain nano-scale tungsten carbide particles forms a tungsten carbide cobalt material having low grain growth and which preserves the tungsten carbide particle size as it is dispersed in the metal matrix. Heating rates during spark plasma sintering range from 500-1,000° C./min and can range from 600-1,400, 700-1,300, 800-1,200, 900-1,100 and about 1,000° C./min. The presence of sufficient amounts of cobalt powder during the sintering provides adequate electrical conductivity. Pressure is preferably 1-500 MPas, more preferably 5-400, 10-300, 20-200, 30-100, 40-90, 50-80, 60-70 MPa during sintering.

Spark plasma sintering can be carried out in an apparatus in which a pulverulent mixture is held between a punch and a die that may be compressed concurrently with the application of an electrical current to the pulverulent mixture. The result is concurrent pressurization and plasma forming to provide a product having high densification.

Preferably the WC particles present in the pulverulent mixture that is subjected to spark plasma sintering have the same grain size and/or particle size as the tungsten carbide present in the sintered product. A grain size of 15-45 nm is preferred. In one embodiment the spark plasma sintered tungsten carbide-cobalt cemented carbide comprises tungsten carbide particles having an average particle size of less than 20 nm, a cobalt metal matrix, a vanadium carbide as a grain growth inhibitor, and a chromium carbide as a grain growth inhibitor.

To demonstrate different aspects of the disclosure different amounts and combinations of grain growth inhibitors were added to a basic WC-Co powder and subject to SPS.

The synthesis formed refined materials having a final attained microstructure providing improved hardness in combination with improved toughness. Initially WC-Co powders were mechanical alloyed through ball milling to ensure homogenous distribution of the second phase in to the WC matrix, preferably planetary ball milling. VC and $Cr_3C_2$ (as grain growth inhibitors) were then added both individually and also in combination under different amounting to the WC-Co composition. All resulting powder compositions were then consolidated through spark plasma sintering at different temperatures, targeting to retard grain growth, during the sintering process, and hence to preserve the improved mechanical properties of these materials. Nevertheless, the adequate addition of inhibitors is needed as excessive addition can lead to an adverse effect and may not effectively retard grain growth.

Both inhibitors (VC and $Cr_3C_2$) were added separately and in different combinations in the range of 0.2, 0.4, 0.6, 0.8% wt to the basic WC-Co powder compositions. The amount of Co, as binding material was also investigated, aiming to reach best combination of properties of these cemented carbides. Results are tabulated in Table 1-3 below.

Density measurements were taken using Archimedes principle, Vickers hardness (HV30) was recorded using universal hardness testing, while fracture toughness was evaluated using crack length and indent length under optical microscope employing the mathematical relationship between fracture toughness and crack length:

$$K_{1c} = A \cdot \sqrt{HV}\,\sqrt{P/\sum l} \tag{1}$$

where $K_{1c}$ is the fracture toughness $MNm^{-3/2}$; HV is the hardness in MPa; P is the indentation load in N; Σl is the sum of crack lengths in mm and A is the constant factor 0.0028. Hardness was measured by Vickers indentation with 30 kg load. Grain size measurement was carried out by linear intercept method while FE-SEM and optical microscope (MEIJI-Techno microscope, Japan) were also used for morphological and microstructural characterization. Additionally, synthesized powders were investigated using Bruker-D8 XRD with Cu radiation (λ=0.15418 nm) at operating conditions of 40 kV and 40 mA. Moreover, indirect measurements of crystallite sizes were performed using Scherrer relation and Williamson's-Hall plots from the broadening of XRD peaks.

TABLE 1

Series of compositional mixtures with relative SPS temperatures and respective properties.

| Sample No. | Sample composition | SPS temperature | Relative densification | $H_{v30}$ |
|---|---|---|---|---|
| 01 | WC(3.5 μm)—9Co | 1200° C. | 99.2 | 1602 |
| 02 | WC(10 nm)—9Co | 1200° C. | 92.5 | 1361 |
| 03 | WC(10 nm)—17Co | 1200° C. | 99.5 | 1625 |
| 04 | WC(10 nm)—20Co | 1200° C. | 99.1 | 1493 |
| 05 | WC(10 nm)—25Co | 1200° C. | 98.8 | 1225 |
| 06 | WC(3.5 μm)—9Co—0.6VC | 1200° C. | 98.83 | 1376 |
| 07 | WC(3.5 μm)—9Co—0.6$Cr_3C_2$ | 1200° C. | 99.15 | 1459 |
| 08 | WC(10 nm)—9Co—0.6VC | 1200° C. | 97.47 | 852 |
| 09 | WC(10 nm)—9Co—0.6$Cr_3C_2$ | 1200° C. | 97.54 | 800 |
| 10 | WC(10 nm)—12Co—0.6VC | 1200° C. | 98.35 | 957 |
| 11 | WC(10 nm)—12Co—0.6$Cr_3C_2$ | 1200° C. | 97.55 | 312 |
| 12 | WC(10 nm)—9Co—0.6VC | 1300° C. | 98.43 | 605 |
| 13 | WC(10 nm)—9Co—0.6$Cr_3C_2$ | 1300° C. | 98.36 | 1445 |

TABLE 1-continued

Series of compositional mixtures with relative SPS temperatures and respective properties.

| Sample No. | Sample composition | SPS temperature | Relative densification | $H_{v30}$ |
|---|---|---|---|---|
| 14 | WC(10 nm)—12Co—0.6VC | 1300° C. | 98.78 | 1432 |
| 15 | WC(10 nm)—12Co—0.6$Cr_3C_2$ | 1300° C. | 99.13 | 1592 |

TABLE 2

Figure 5:
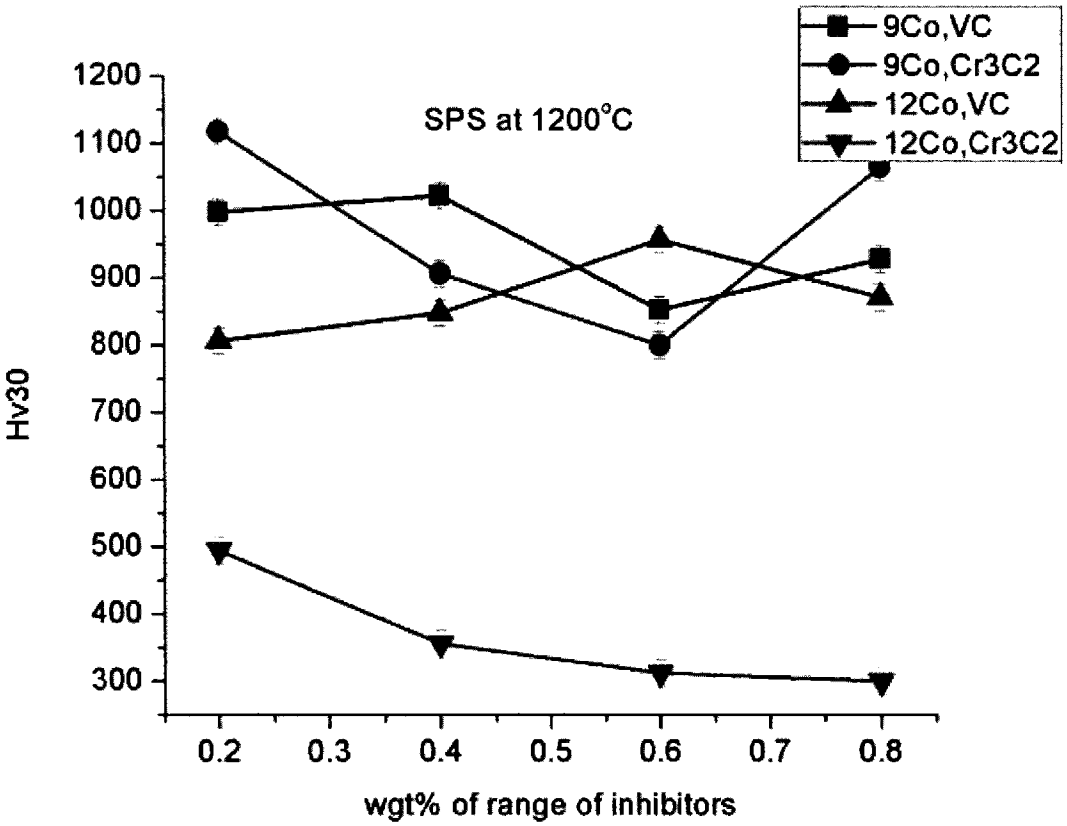
FIG. 5 shows hardness of compositions spark plasma sintered at varying grain growth inhibitor amounts.
Figure 6:
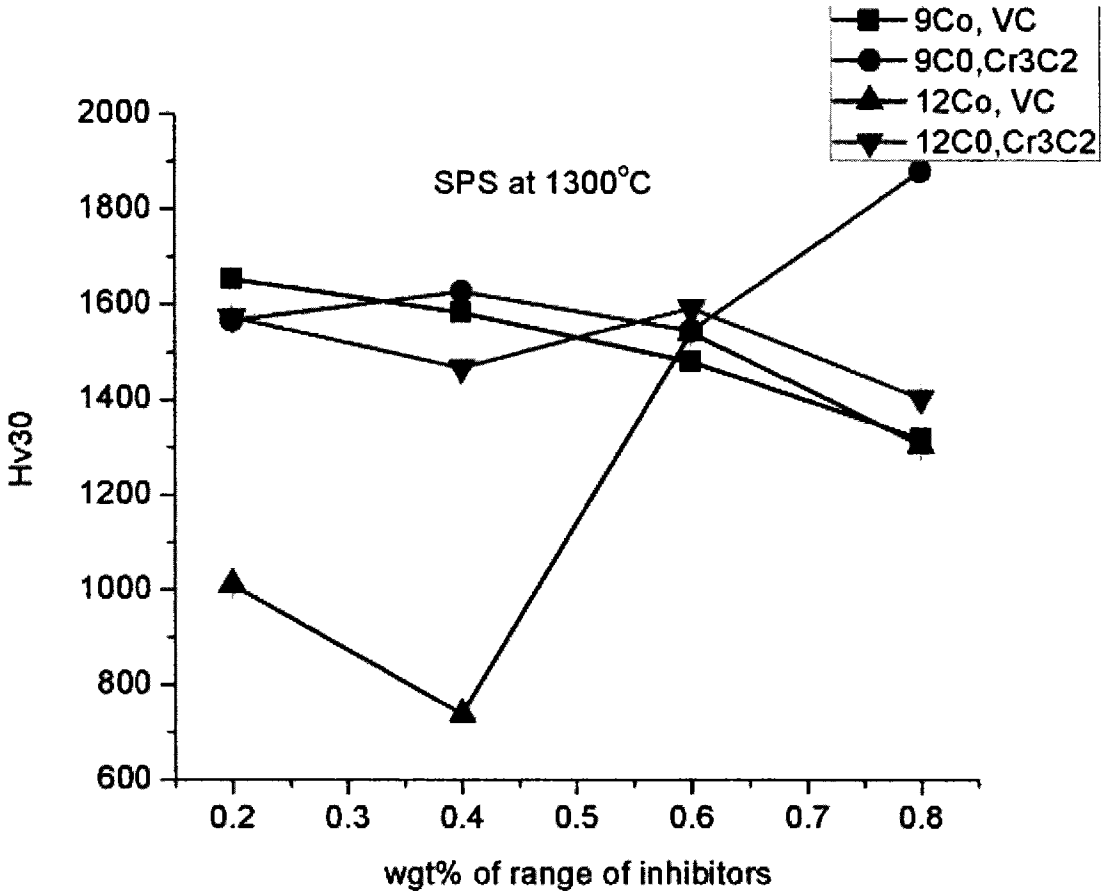
FIG. 6 shows hardness of compositions spark plasma sintered at varying grain growth inhibitor amounts.
Figure 7:
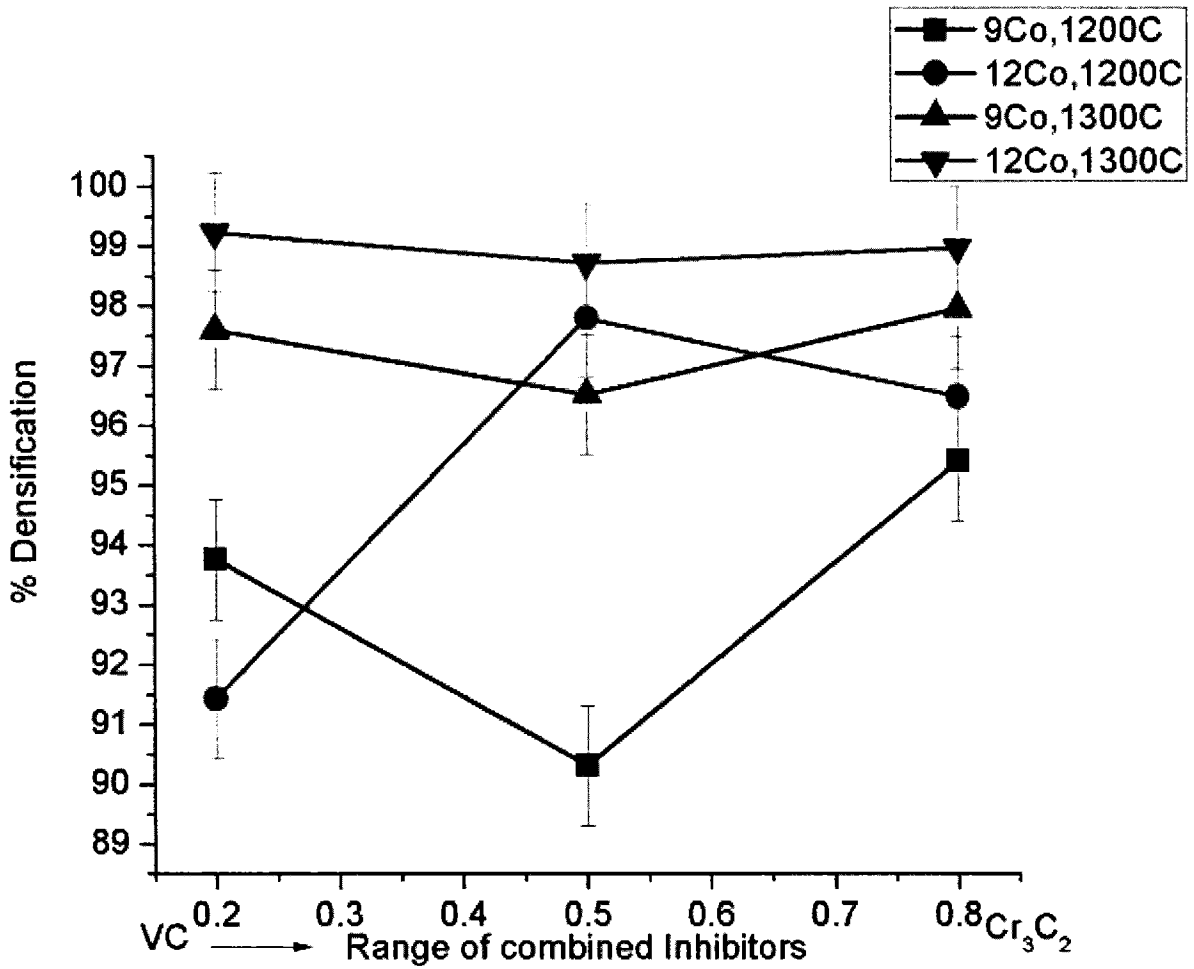
FIG. 7 shows densification of compositions subject to spark plasma sintering with two grain growth inhibitors.
Figure 8:
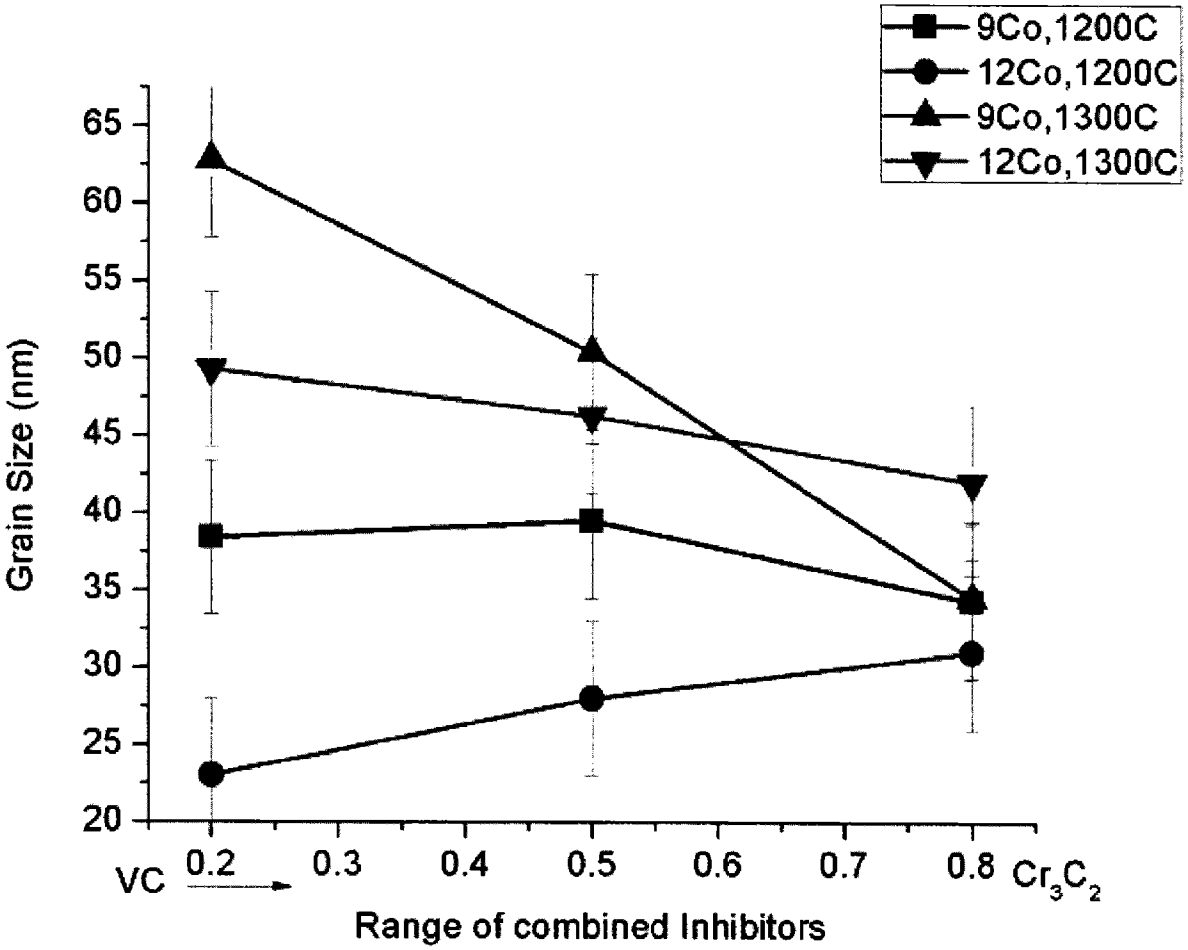
FIG. 8 shows grain size of compositions spark plasma sintered with two different grain growth inhibitors.

Addition of individual range of inhibitors to series of compositional mixtures. Respective properties of the resulted composite are shown in FIGS. 5-6.

| Sample No. | Sample composition | SPS temperature |
|---|---|---|
| 16 | WC(10 nm)—9Co—0.2VC | 1200° C. |
| 17 | WC(10 nm)—9Co—0.4VC | 1200° C. |
| 18 | WC(10 nm)—9Co—0.6VC | 1200° C. |
| 19 | WC(10 nm)—9Co—0.8VC | 1200° C. |
| 20 | WC(10 nm)—9Co—0.2$Cr_3C_2$ | 1200° C. |
| 21 | WC(10 nm)—9Co—0.4$Cr_3C_2$ | 1200° C. |
| 22 | WC(10 nm)—9Co—0.6$Cr_3C_2$ | 1200° C. |
| 23 | WC(10 nm)—9Co—0.8$Cr_3C_2$ | 1200° C. |
| 24 | WC(10 nm)—12Co—0.2VC | 1200° C. |
| 25 | WC(10 nm)—12Co—0.4VC | 1200° C. |
| 26 | WC(10 nm)—12Co—0.6VC | 1200° C. |
| 27 | WC(10 nm)—12Co—0.8VC | 1200° C. |
| 28 | WC(10 nm)—12Co—0.2$Cr_3C_2$ | 1200° C. |
| 29 | WC(10 nm)—12Co—.4$Cr_3C_2$ | 1200° C. |
| 30 | WC(10 nm)—12Co—0.6$Cr_3C_2$ | 1200° C. |
| 31 | WC(10 nm)—12Co—0.8$Cr_3C_2$ | 1200° C. |
| 32 | WC(10 nm)—9Co—0.2VC | 1300° C. |
| 33 | WC(10 nm)—9Co—0.4VC | 1300° C. |
| 34 | WC(10 nm)—9Co—0.6VC | 1300° C. |
| 35 | WC(10 nm)—9Co—0.8VC | 1300° C. |
| 36 | WC(10 nm)—9Co—0.2$Cr_3C_2$ | 1300° C. |
| 37 | WC(10 nm)—9Co—0.4$Cr_3C_2$ | 1300° C. |
| 38 | WC(10 nm)—9Co—0.6$Cr_3C_2$ | 1300° C. |
| 39 | WC(10 nm)—9Co—0.8$Cr_3C_2$ | 1300° C. |
| 40 | WC(10 nm)—12Co—0.2VC | 1300° C. |
| 41 | WC(10 nm)—12Co—0.4VC | 1300° C. |
| 42 | WC(10 nm)—12Co—0.6VC | 1300° C. |
| 43 | WC(10 nm)—12Co—0.8VC | 1300° C. |
| 44 | WC(10 nm)—12Co—.2$Cr_3C_2$ | 1300° C. |
| 45 | WC(10 nm)—12Co—0.4$Cr_3C_2$ | 1300° C. |
| 46 | WC(10 nm)—12Co—0.6$Cr_3C_2$ | 1300° C. |
| 47 | WC(10 nm)—12Co—0.8$Cr_3C_2$ | 1300° C. |

TABLE 3

Figure 9:
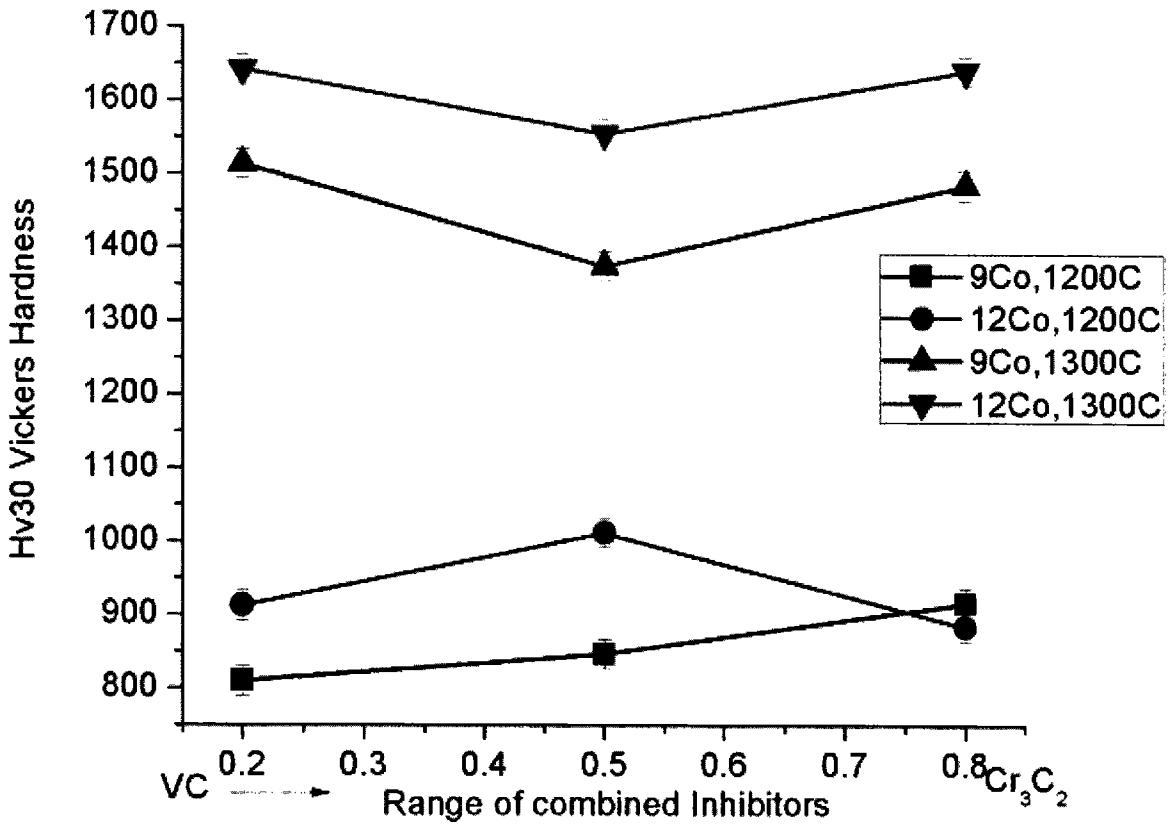
FIG. 9 shows hardness of compositions spark plasma sintered with varying amounts of two different grain growth inhibitors.
Figure 10:
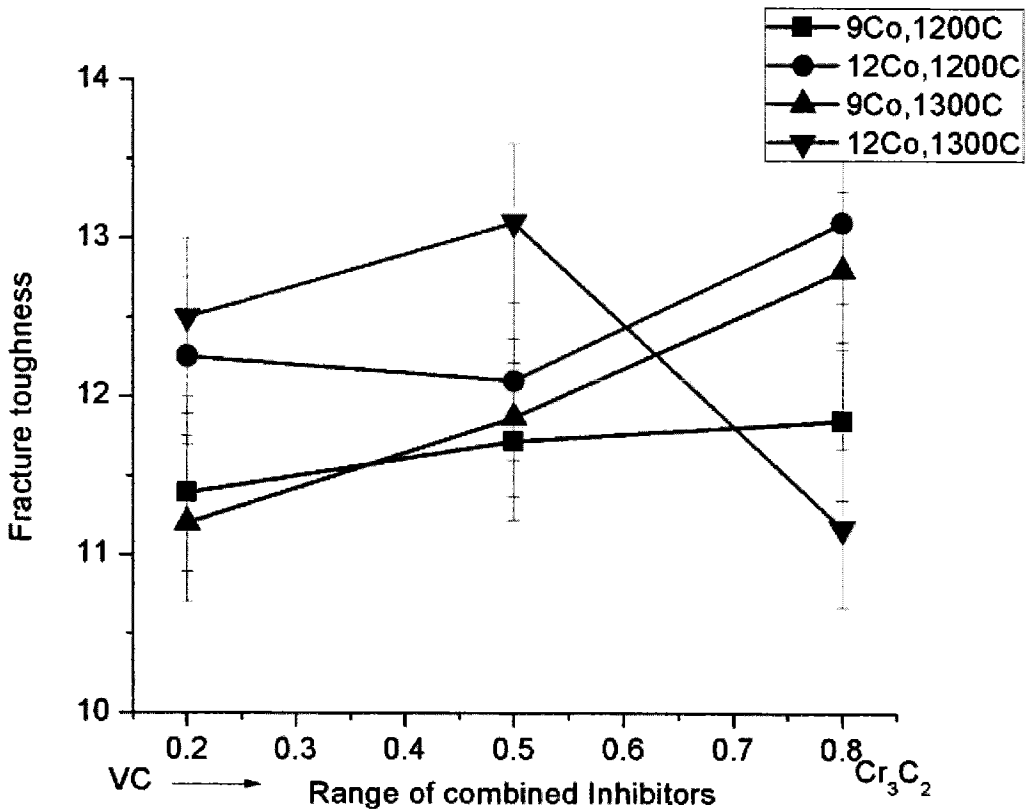
FIG. 10 shows fracture toughness of compositions spark plasma sintered at varying amounts of two different grain growth inhibitors.

Addition of Combined range of inhibitors to series of compositional mixtures. Respective properties of the resulted composite are shown in FIGS. 9-10.

| Sample No. | Sample composition | SPS temperature |
|---|---|---|
| 48 | WC(10 nm)—9Co—0.5VC—0.5$Cr_3C_2$ | 1200° C. |
| 49 | WC(10 nm)—9Co—0.8VC—0.2$Cr_3C_2$ | 1200° C. |
| 50 | WC(10 nm)—9Co—0.2VC—0.8$Cr_3C_2$ | 1200° C. |
| 51 | WC(10 nm)—9Co—0.5VC—0.5$Cr_3C_2$ | 1300° C. |
| 52 | WC(10 nm)—9Co—0.8VC—0.2$Cr_3C_2$ | 1300° C. |
| 53 | WC(10 nm)—9Co—0.2VC—0.8$Cr_3C_2$ | 1300° C. |
| 54 | WC(10 nm)—12Co—0.5VC—0.5$Cr_3C_2$ | 1200° C. |
| 55 | WC(10 nm)—12Co—0.8VC—0.2$Cr_3C_2$ | 1200° C. |
| 56 | WC(10 nm)—12Co—0.2VC—0.8$Cr_3C_2$ | 1200° C. |
| 57 | WC(10 nm)—12Co—0.5VC—0.5$Cr_3C_2$ | 1300° C. |
| 58 | WC(10 nm)—12Co—0.8VC—0.2$Cr_3C_2$ | 1300° C. |
| 59 | WC(10 nm)—12Co—0.2VC—0.8$Cr_3C_2$ | 1300° C. |

High heating rates of spark plasma sintering and higher diffusion kinetics of using finer initial powder have advantages of improving mechanical properties of the resulted nanocomposite. However these parameters gives rise to grain growth which further degrade the properties, But this work has successfully developed nano-structured WC-Co composite by adding adequate amount of VC and $Cr_3C_2$, as grain growth inhibitors in the mixed powder composition. The attained nanocomposite was found to have improved hardness of 1690Hv30 and 12.5 Mpam1/2 values respectively. It was found that after exploring all these ranges of compositions that the best alloy that combines high density and hardness is WC-12Co-0.2VC-0.8$Cr_3C_2$. The carried out work in this invention introduces a new material that can be used in industrial practice.

In embodiments of the disclosure the cemented carbides had almost full densification of the alloy WC-12Co-0.2VC-0.8$Cr_3C_2$ attaining average of 50 nm crystallite size, hardness of 1690 Hv30 and fracture toughness of 12.5 $Mpam^{1/2}$.

Higher surface area of initial powder particles shall be compensated by higher amount of binding material, which shall be adequate or otherwise will degrade hardness of the resulted nanocomposite.

Higher amount of inhibitors, more than critical value of 0.6 wt %, have resulted in reduction in densification.

Figure 4:
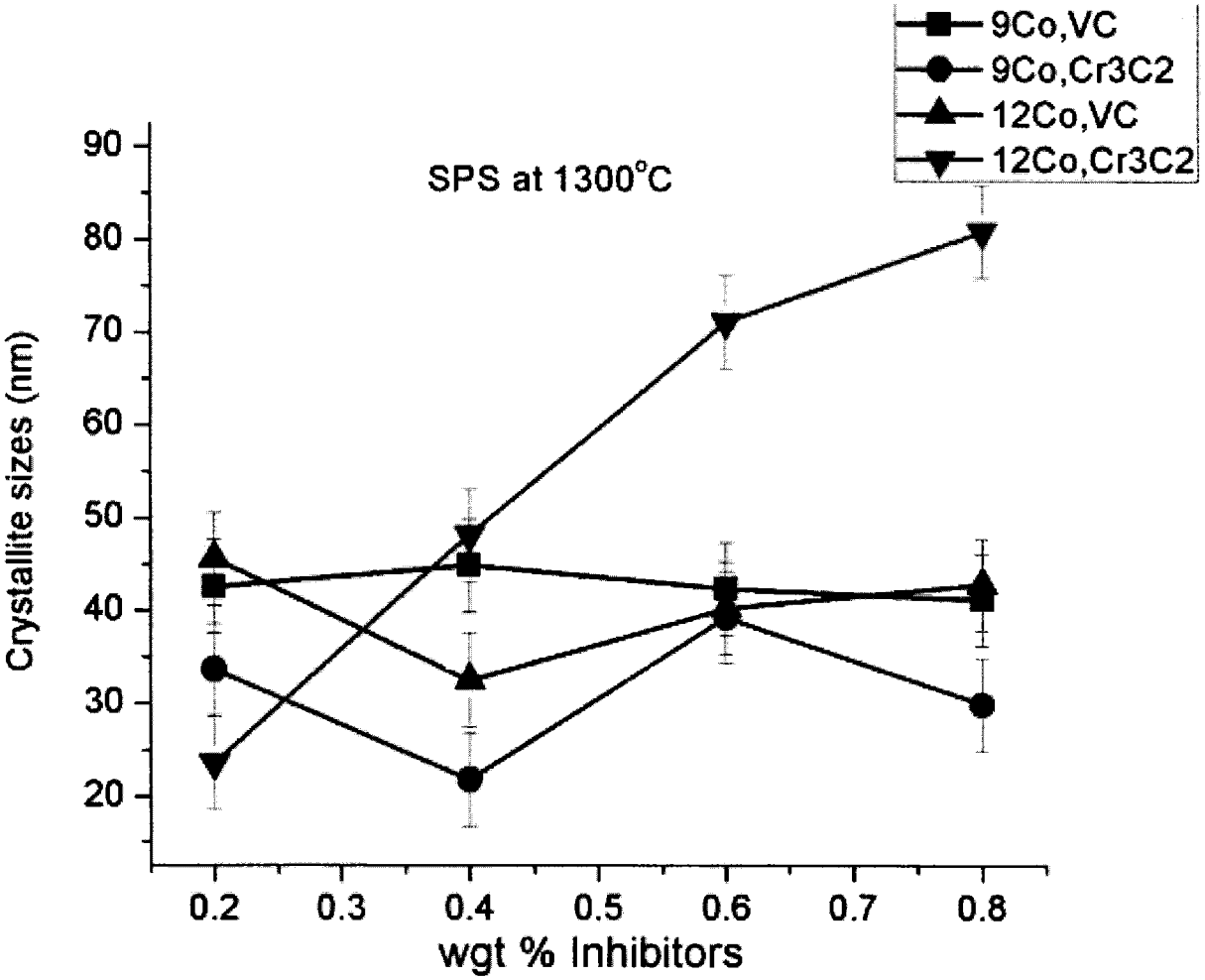
FIG. 4 shows crystallite size of compositions spark plasma sintered with varying amounts of grain growth inhibitors.

Higher densification in samples containing $Cr_3C_2$, while lower in samples containing VC can be linked to the presence of comparatively higher amount of micro-porosity in these samples, as shown in FIG. 4. However VC has been noticed to be comparatively more active in restricting/retarding grain growth.

Combination of both inhibitors in the alloy WC-12Co-0.2VC-0.8$Cr_3C_2$ resulted in further improving the mechanical properties.

Results reveal that VC is comparatively more active in inhibiting grains to grow, while $Cr_3C_2$ was found to be more active in attaining comparatively higher densification, and higher hardness values in addition to restricting grain growth. Higher amount of inhibitors' addition was found to result in lower grain sizes and higher hardness values, however adding more than a crucial amount was observed to degrade the mechanical properties.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. A spark plasma sintered tungsten carbide-cobalt cemented carbide, comprising:

tungsten carbide particles having an average particle size of no greater than 20 nm, a cobalt metal matrix, a vanadium carbide as a first grain growth inhibitor, and a chromium carbide as a second grain growth inhibitor, wherein the cobalt metal matrix is present in the cemented carbide in an amount of from 9 to 12% by weight based on the total weight of the tungsten carbide and the cobalt, and the total amount of the vanadium carbide and the chromium carbide is from 0.2 to 0.8 wt % based on the total weight of the tungsten carbide and the cobalt, and wherein the tungsten carbide particles are dispersed in the cobalt metal matrix in disaggregated form.

2. The cemented carbide according to claim 1, having a Vickers hardness (Hv30) of 800-1,750.

3. The cemented carbide of claim 1, having a fracture toughness of from 11 to 13 $MPam^{1/2}$.

4. The cemented carbide of claim 1, having a relative densification of from 97.55 to 99.15%.

5. The cemented carbide of claim 1, comprising from 0.2 to 0.8 wt % of the vanadium carbide.

6. The cemented carbide of claim 1, comprising from 0.2 to 0.8 wt % of the chromium carbide.

7. The cemented carbide of claim 1, wherein the total amount of the vanadium carbide and the chromium carbide is from 0.2 to 0.6 wt %.

8. A process for forming the cemented carbide of claim 1, comprising:

spark plasma sintering a pulverulent mixture of WC particles, Co particles, VC particles and $Cr_3C_2$ particles.

9. The process of claim 8, wherein the spark plasma sintering is carried out at a temperature of from 1,200 to 1,300° C.

10. The process of claim 8, wherein the spark plasma sintering forms a product having a hardness of 1650-1700Hv30.

11. The process of claim 8, wherein the spark plasma sintering is carried out at a pressure of 50 MPa or less.

12. The process of claim 8, wherein the sintered tungsten carbide formed by the spark plasma sintering has a tungsten carbide grain size of 10 nm or less.

13. The process of claim 8, wherein the spark plasma sintering forms a tungsten carbide cobalt comprising 0.1-0.3 wt % of vanadium carbide and 0.6-0.7 wt % chromium carbide, wherein wt % is based on the total weight of the tungsten carbide and the cobalt.

* * * * *